US010251447B2

(12) United States Patent
Schiller et al.

(10) Patent No.: US 10,251,447 B2
(45) Date of Patent: Apr. 9, 2019

(54) ARTICLE INCLUDING AN OUTER LAYER WITH AREAS OF VARYING HARDNESSES

(71) Applicant: NIKE, Inc., Beaverton, OR (US)

(72) Inventors: Denis Schiller, Vancouver, WA (US); Jeremy D. Walker, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 6 days.

(21) Appl. No.: 15/528,808

(22) PCT Filed: Nov. 11, 2015

(86) PCT No.: PCT/US2015/060126
§ 371 (c)(1),
(2) Date: May 23, 2017

(87) PCT Pub. No.: WO2016/077443
PCT Pub. Date: May 19, 2016

(65) Prior Publication Data

US 2017/0318902 A1 Nov. 9, 2017

Related U.S. Application Data

(60) Provisional application No. 62/078,774, filed on Nov. 12, 2014.

(51) Int. Cl.

| | |
|---|---|
| ***A43B 13/00*** | (2006.01) |
| ***A43B 13/18*** | (2006.01) |
| ***A43C 13/04*** | (2006.01) |
| ***A43B 5/02*** | (2006.01) |
| ***A43B 13/12*** | (2006.01) |
| ***A43C 15/16*** | (2006.01) |
| ***A43B 13/04*** | (2006.01) |

(52) U.S. Cl.
CPC ..... *A43B 13/186* (2013.01); *A43B 5/02* (2013.01); *A43B 13/04* (2013.01); *A43B 13/122* (2013.01); *A43B 13/188* (2013.01); *A43C 13/04* (2013.01); *A43C 15/161* (2013.01); *A43C 15/168* (2013.01)

(58) Field of Classification Search
CPC .. A43B 5/00; A43B 5/02; A43B 13/00; A43B 13/186; A43B 13/187; A43C 13/04
USPC ..... 36/28, 128, 134, 67 R
See application file for complete search history.

(56) References Cited

U.S. PATENT DOCUMENTS

| | | | | |
|---|---|---|---|---|
| 3,341,952 A * | 9/1967 | Dassler | ..... | A43B 5/02 36/128 |
| 3,747,238 A | 7/1973 | JanKauskas | | |
| 4,271,608 A | 6/1981 | Tomuro | | |

(Continued)

FOREIGN PATENT DOCUMENTS

| | | |
|---|---|---|
| DE | 3507295 A1 | 9/1986 |
| GB | 2508244 A | 5/2014 |
| WO | WO-99/26505 A1 | 6/1999 |

OTHER PUBLICATIONS

International Searching Authority, International Search Report and Written Opinion for International Application No. PCT/US2015/060126, dated Feb. 2, 2016.

*Primary Examiner* — Marie D Bays
(74) *Attorney, Agent, or Firm* — Honigman LLP; Matthew H. Szalach; Jonathan P. O'Brien

(57) ABSTRACT

An article of footwear has a sole structure with a resilient outer layer. The outer layer includes a continuous region and a discontinuous region. The continuous region and the discontinuous region have different hardnesses.

22 Claims, 9 Drawing Sheets

(56) References Cited

U.S. PATENT DOCUMENTS

| | | | | |
|---|---|---|---|---|
| 5,065,534 | A | 11/1991 | Collins | |
| 5,077,916 | A * | 1/1992 | Beneteau | A43B 5/001 36/128 |
| 5,709,954 | A * | 1/1998 | Lyden | A43B 5/00 12/142 R |
| 8,935,861 | B2 * | 1/2015 | Baker | A43B 1/0018 36/128 |
| 2011/0088287 | A1 * | 4/2011 | Auger | A43B 5/02 36/107 |
| 2012/0291315 | A1 | 11/2012 | Baucom et al. | |
| 2017/0318902 | A1 * | 11/2017 | Schiller | A43B 5/02 |

* cited by examiner

ARTICLE INCLUDING AN OUTER LAYER WITH AREAS OF VARYING HARDNESSES

CROSS REFERENCE TO RELATED APPLICATIONS

This application is the U.S. national phase of International Application No. PCT/US2015/060126, filed on Nov. 11, 2015, which claims the benefit of U.S. Provisional Patent Application No. 62/078,774 filed on Nov. 12, 2014, the entire disclosures of which are incorporated herein by reference.

BACKGROUND

The present embodiments relate generally to an article of footwear and, more particularly, to a sports shoe with cleats.

Articles of footwear having cleats have previously been proposed. While conventional cleats generally help give sports shoes more grip, the cleats often accumulate mud when the article of footwear is worn in muddy conditions. In some instances, the mud accumulates on a shaft of the cleats and in the spaces between the cleats. The accumulation of mud weighs down the article of footwear and interferes with the traction between the cleats and the ground.

BRIEF DESCRIPTION OF THE DRAWINGS

The embodiments can be better understood with reference to the following drawings and description. The components in the Figures are not necessarily to scale, emphasis instead being placed upon illustrating the principles of the embodiments. Moreover, in the figures, like reference numerals designate corresponding parts throughout the different views.

DETAILED DESCRIPTION

Figure 1:
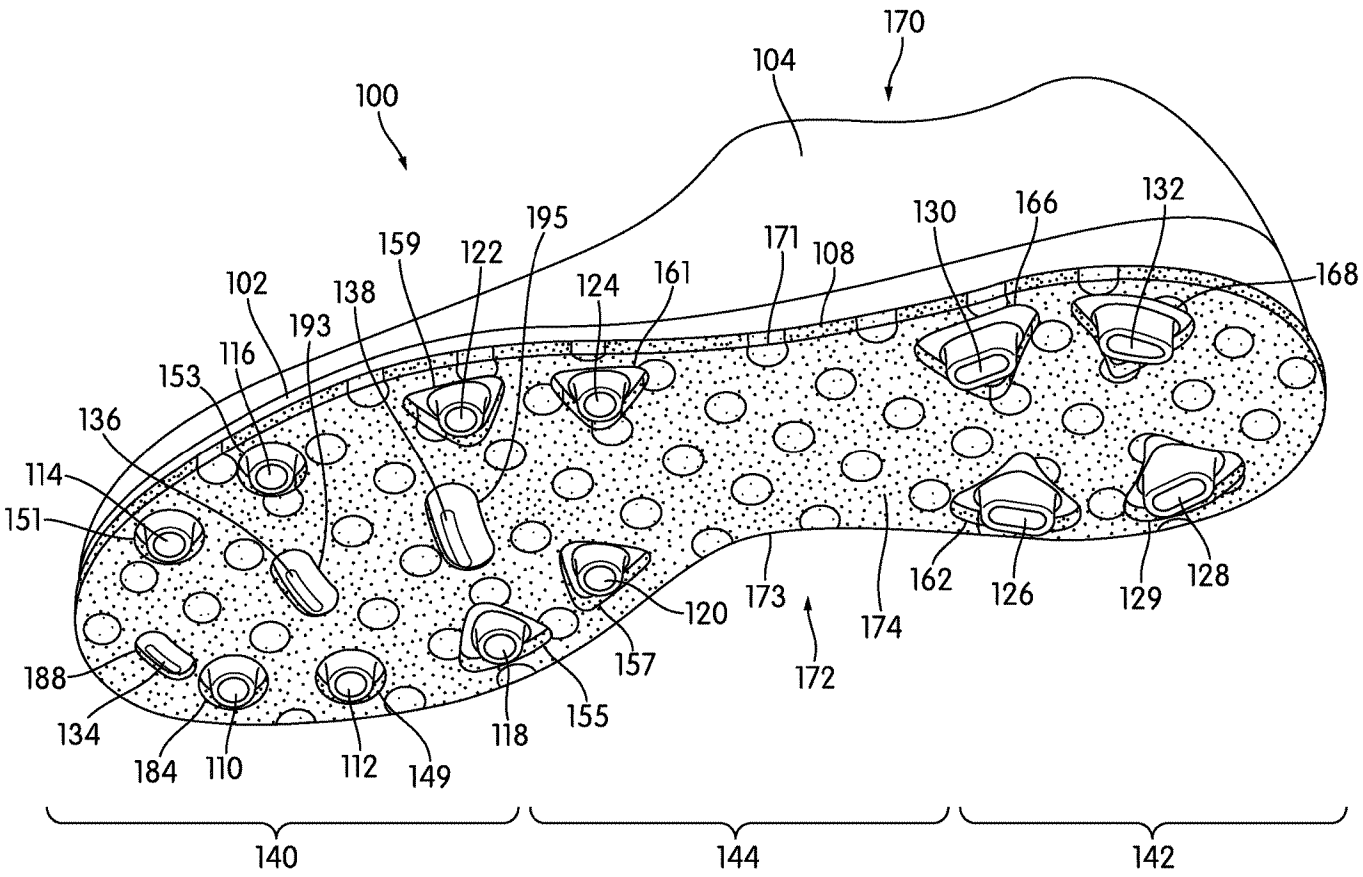
FIG. 1 is an isometric view of an exemplary embodiment of an article of footwear with a sole plate with cleats.

The present disclosure is directed to a sole structure including a plate and an outer layer. In one embodiment the outer layer comprises a first region and a second region. The first region is substantially continuous. The second region includes a plurality of resilient members. The plurality of resilient members are substantially discontinuous. Each of the resilient members has a hardness that is at least 15 Asker C hardness greater than the Asker C hardness value of the first region. The first region extends from an upper surface of the outer layer to a lower surface of the outer layer. The plurality of resilient members also extends from the upper surface of the outer layer to the lower surface of the outer layer. The first region has a first exposed outer surface. The plurality of resilient members have a second exposed outer surface. The first exposed outer surface being flush with the second exposed outer surface. Each of the plurality of resilient members has a sidewall. Each sidewall extends from the upper surface to the lower surface. Each of the plurality of resilient members is joined to the first region along the entire sidewall.

In some embodiments the plate may have a hardness of at least 90 Shore A. The plate may have a hardness of at least 92 Shore A. The plate may have a hardness of at least 95 Shore A. The plate may have a hardness of about 92 Shore A. The plate may have a hardness of about 95 Shore A. The plate may be substantially incompressible. Further, the first region may have a hardness between about 25 and about 60 Asker C.

In some embodiments, the plate includes at least one cleat, and a portion of the cleat extends beyond the first exposed outer surface.

In some embodiments, the first region has a first surface area and the second region has a cumulative surface area. The cumulative surface area is between about 15 percent to about 50 percent of the total of the first surface area and the cumulative surface area.

In some embodiments, the first region has a hardness between about 10 and about 45 Asker C.

In some embodiments, the plurality of resilient members have a hardness between about 25 and about 60 Asker C.

In some embodiments, the first region is composed of polyester polyurethane foam.

In some embodiments, each of the plurality of resilient members has a characteristic measurement. In some embodiments, each of the plurality of resilient members is spaced apart by a distance of between about 150 percent to about 180 percent of the characteristic measurement from the center of each of the plurality of resilient members.

In some embodiments, the characteristic measurement of the plurality of resilient members is between about 1 mm and about 20 mm.

In some embodiments, the plurality of resilient members includes a first resilient member and a second resilient member. The first resilient member and the second resilient member may be cylindrical. Each cylinder may have a face at the upper surface and a face at the lower surface.

In some embodiments the plurality of resilient members may include a first resilient member and a second resilient member. The first resilient member and the second resilient member may be essentially evenly spaced from one another.

In some embodiments, following a 30 minute wear test on a wet grass field, a weight of debris adsorbed to the sole structure is at least 15% less than a weight of debris adsorbed to an exterior surface of a control sole structure. The control sole structure is identical to the sole structure except that the control sole structure includes a control layer consisting of a material used to form the first region or consisting of a material used to form the second region. Additionally the control sole structure does not include the outer layer.

In some embodiments an upper may be attached to the sole structure.

The present disclosure is also directed to a method of manufacturing a sole structure. The method includes forming an outer layer material having a first region and a second region. The first region is substantially continuous. The second region includes a plurality of resilient members. The plurality of resilient members are substantially discontinuous. Each of the resilient members has a hardness that is at least 15 Asker C hardness greater than the Asker C hardness value of the first region. The first region extends from an upper surface of the outer layer to a lower surface of the outer layer. The plurality of resilient members also extends from the upper surface of the outer layer to the lower surface of the outer layer. The first region has a first exposed outer surface. The plurality of resilient members have a second exposed outer surface. The first exposed outer surface being flush with the second exposed outer surface. Each of the plurality of resilient members has a sidewall. Each sidewall extends from the upper surface to the lower surface. Each of the plurality of resilient members is joined to the first region along the entire sidewall. The method further including attaching the outer layer to the plate.

In some embodiments, each of the plurality of resilient members has a characteristic measurement. Each of the plurality of resilient members may be spaced apart by a distance of between about 150 percent to about 180 percent of the characteristic measurement from the center of each of the plurality of resilient members.

In some embodiments the first resilient member and the second resilient member have essentially the same shape.

In some embodiments, the method further includes attaching an upper to the sole structure.

In some embodiments, the plurality of resilient members includes a first resilient member and a second resilient member. The first resilient member and the second resilient member may be essentially evenly spaced from one another.

In some embodiments, the method further includes providing the plate with at least one cleat, a portion of the cleat extending beyond the first exposed outer surface.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

An article of footwear having a self-cleaning or non-clogging surface is disclosed. The article of footwear may include a sole plate having cleats associated with outer layers. For example, FIGS. 1-5 illustrate an exemplary embodiment of a sole plate 102 may include a first cleat 110 having an outer layer 174. The outer layer associated with the cleats may prevent mud from accumulating on the cleats and/or a lower surface of the sole plate by compressing against a surface of the ground and then springing back, preventing mud from sticking to the outer layer. For example, FIGS. 8-10 (described in more detail below) show an outer layer before, during, and after cleats are submerged in mud. Preventing mud from accumulating in the area surrounding the cleats may also prevent mud from accumulating on the cleats and in the spaces between the cleats.

The following Detailed Description discusses an exemplary embodiment in the form of soccer boots, but it should be noted that the present concept may be associated with any article of footwear, including, but not limited to, baseball shoes, rugby shoes, and football shoes. The articles of footwear shown in the Figures may be intended to be used with a left foot. However, it should be understood that the following discussion may apply to mirror images of the articles of footwear that may be intended to be used with a right foot.

For consistency and convenience, directional adjectives are employed throughout this Detailed Description corresponding to the illustrated embodiments. The term "longitudinal direction" as used throughout this detailed description and in the claims refers to a direction extending from heel to toe, which may be associated with the length, or longest dimension, of an article of footwear such as a sports or recreational shoe. Also, the term "lateral direction" as used throughout this Detailed Description and in the claims refers to a direction extending from side to side (lateral side and medial side) or the width of an article of footwear. The lateral direction may generally be perpendicular to the longitudinal direction. The term "vertical direction" as used with respect to an article of footwear throughout this Detailed Description and in the claims refers to the direction that is normal to the plane of the sole of the article of footwear. Moreover, the vertical direction may generally be perpendicular to both the longitudinal direction and the lateral direction.

The term "sole" as used herein shall refer to any combination that provides support for a wearer's foot and bears the surface that is in direct contact with the ground or playing surface, such as a single sole; a combination of an outsole and an inner sole; a combination of an outsole, a midsole and an inner sole, and a combination of an outer layer, an outsole, a midsole and an inner sole.

In some embodiments, the sole plate may be associated with an upper. For example, as shown in FIG. 1, sole plate 102 may be associated with upper 104. The upper may be attached to the sole plate by any known mechanism or method. For example, upper 104 may be stitched to sole plate 102 or upper 104 may be glued to sole plate 102. The upper may be configured to receive a foot. The exemplary embodiment shows a generic design for the upper. In some embodiments, the upper may include another type of design.

The sole plate and upper may be made from materials known in the art for making articles of footwear. For example, the sole plate may be made from elastomers, siloxanes, natural rubber, synthetic rubbers, aluminum, steel, natural leather, synthetic leather, plastics, or thermoplastics. In some embodiments, the material used to form the sole plate may have a hardness of at least 90 Shore A. In other embodiments, the sole plate may have a higher Shore A value or a lower Shore A value. In another example, the upper may be made from nylon, natural leather, synthetic leather, natural rubber, or synthetic rubber.

The sole plate may have an upper surface and a lower surface. For example, referring to FIGS. 1-5, sole plate 102 may include an upper surface 306 and a lower surface 108. The sole plate may be configured to be attached to the upper. The sole plate may also be configured to be attached to a midsole or an insole of an article of footwear. Additionally, the sole plate may be attached to a sock liner. The upper surface may be configured to contact the midsole or the insole or sock liner. The sole plate may include a forefoot region disposed proximate a wearer's forefoot. For example, sole plate 102 may include a forefoot region 140. The sole plate may include a heel region disposed proximate a wearer's heel and opposite the forefoot region. For example, sole plate 102 may include a heel region 142. The sole plate may include a midfoot region disposed between the forefoot region and the heel region. For example, sole plate 102 may include a midfoot region 144. The sole plate may include a medial side and a lateral side opposite the medial side. For example, sole plate 102 may include a medial side 172 and a lateral side 170. The sole plate may include a medial edge on the medial side and a lateral edge on the lateral side. The sole plate may include a forward edge in the forefoot region and a rearward edge in the heel region and disposed opposite the forward edge.

The lower surface of the sole plate may be configured to contact a playing surface. For example, the lower surface may be configured to contact grass, synthetic turf, dirt, or sand. The lower surface of the sole plate may include provisions for increasing traction with such a playing surface. For example, as shown in FIGS. 1-5, such provisions may include cleats. A first cleat 110, a second cleat 112, a third cleat 114, a fourth cleat 116, a fifth cleat 118, a sixth cleat 120, a seventh cleat 122, and an eighth cleat 124 may be disposed on forefoot region 140 of sole plate 102. A ninth cleat 126, a tenth cleat 128, an eleventh cleat 130, and a twelfth cleat 132 may be disposed on heel region 142 of sole plate 102. A thirteenth cleat 134, a fourteenth cleat 136, and a fifteenth cleat 138 may be disposed on forefoot region 140 of sole plate 102.

In some embodiments, the sole plate may include cleats that extend from the lower surface. For example, as shown in FIGS. 1-5, sole plate 102 may include cleats integrally formed with sole plate 102 through molding. In another example, the sole plate may be configured to receive cleats. In some embodiments, the sole plate may include cleat receiving members configured to receive removable cleats. For example, the cleat receiving members may include threaded holes and the cleats may screw into the threaded holes. In some embodiments, the cleat receiving members may be raised with respect to the sole plate. In other embodiments, the cleat receiving members may be flush with the lower surface of the sole plate.

The cleats may be made from materials known in the art for making articles of footwear. For example, the cleats may be made from elastomers, siloxanes, natural rubber, synthetic rubbers, aluminum, steel, natural leather, synthetic leather, plastics, or thermoplastics. In some embodiments, the cleats may be made of the same materials. In other embodiments, the cleats may be made of various materials. For example, first cleat 110 may be made of aluminum while second cleat 112 is made of a thermoplastic material. In some embodiments, cleats may have the same hardness as the sole plate. In some embodiments, the cleats may have a hardness of at least 9098 Shore A. The cleats may have a hardness of at least 95 Shore A. The cleats may have a hardness of at least 98 Shore A. In other embodiments, the cleats may have a higher or lower Shore A value.

The cleats may have any type of shape. In some embodiments, the cleats may all have the same shape. In other embodiments, at least one of the cleats may have a different shape from another cleat. For example, in the exemplary embodiment shown in FIGS. 1-5, first cleat 110 may be shaped differently from ninth cleat 126. In some embodiments, the cleats may have a first set of identically shaped cleats, a second set of identically shaped cleats, and/or a third set of identically shaped cleats. For example, as shown in FIGS. 1-5, first cleat 110, second cleat 112, third cleat 114, fourth cleat 116, fifth cleat 118, sixth cleat 120, seventh cleat 122, and eighth cleat 124 may make up a first set of cleats having a first shape, while ninth cleat 126, tenth cleat 128, eleventh cleat 130, and twelfth cleat 132 may make up a second set of cleats having a second shape, and thirteenth cleat 134, fourteenth cleat 136, and fifteenth cleat 138 may make up a third set of cleats having a third shape.

Figure 2:
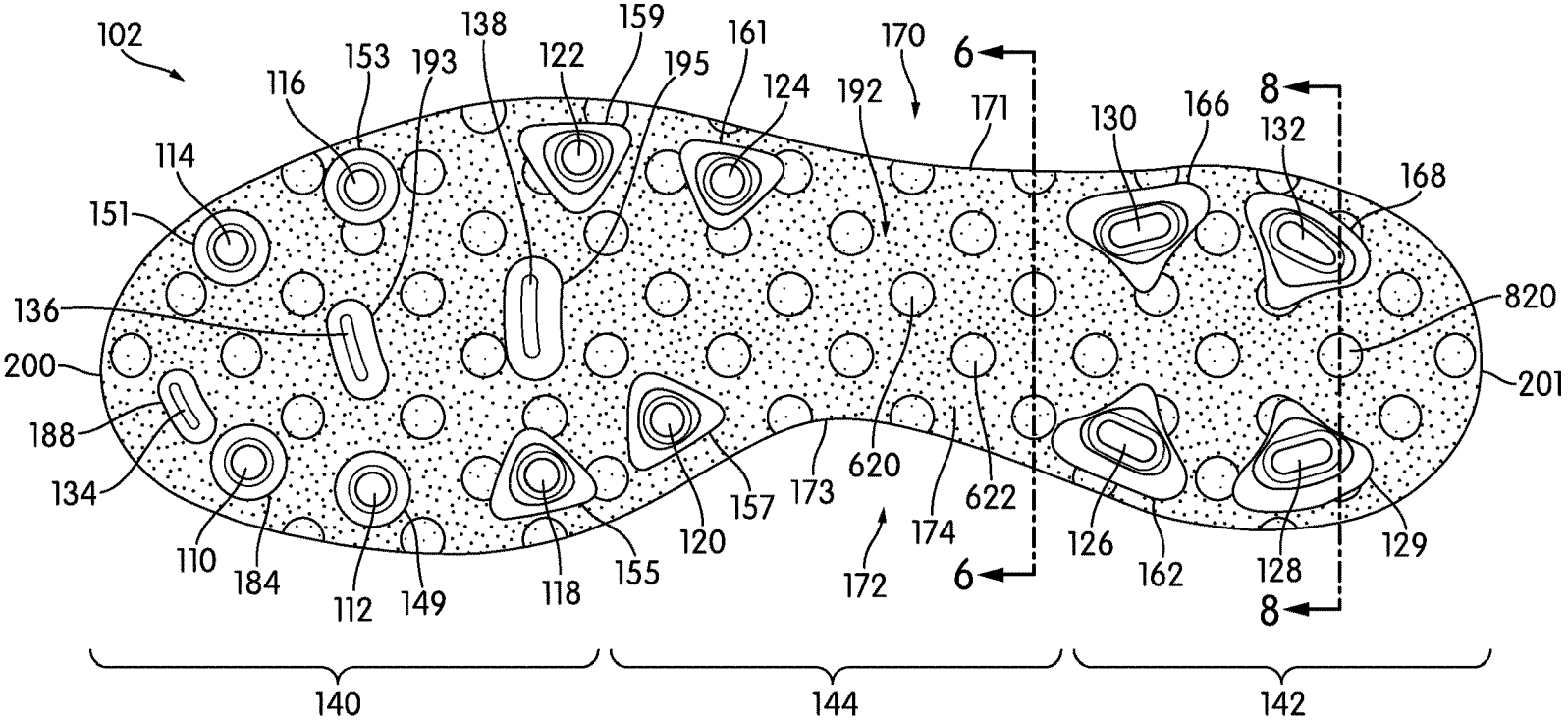
FIG. 2 is a bottom view of the sole plate of FIG. 1.

The cleats may have a shaft extending away from the lower surface of the sole plate. The shaft may have a surface. The cleats may have a terminal end that is disposed opposite the lower surface of the sole plate. For example, as shown in the rear view of tenth cleat 128 and twelfth cleat 132 in FIGS. 8-10, tenth cleat 128 may have a shaft 804 and a terminal end 802 and twelfth cleat 132 may have a shaft 810 and a terminal end 808. In some embodiments, the shaft of at least one cleat may be round. For example, as shown in FIG. 2, the shaft of at least one cleat may form a circular shape (tenth cleat 128) or an oval shape (ninth cleat 126). A surface of the round shaft may formed by a single sidewall. In other embodiments, at least one of the cleats may be a shaft formed from a plurality of sidewalls. For example, a cleat may have three sidewalls forming a triangular shaped shaft. In another example, a cleat may have four sidewalls forming a square shaped shaft or a rectangular shaped shaft.

Figure 8:
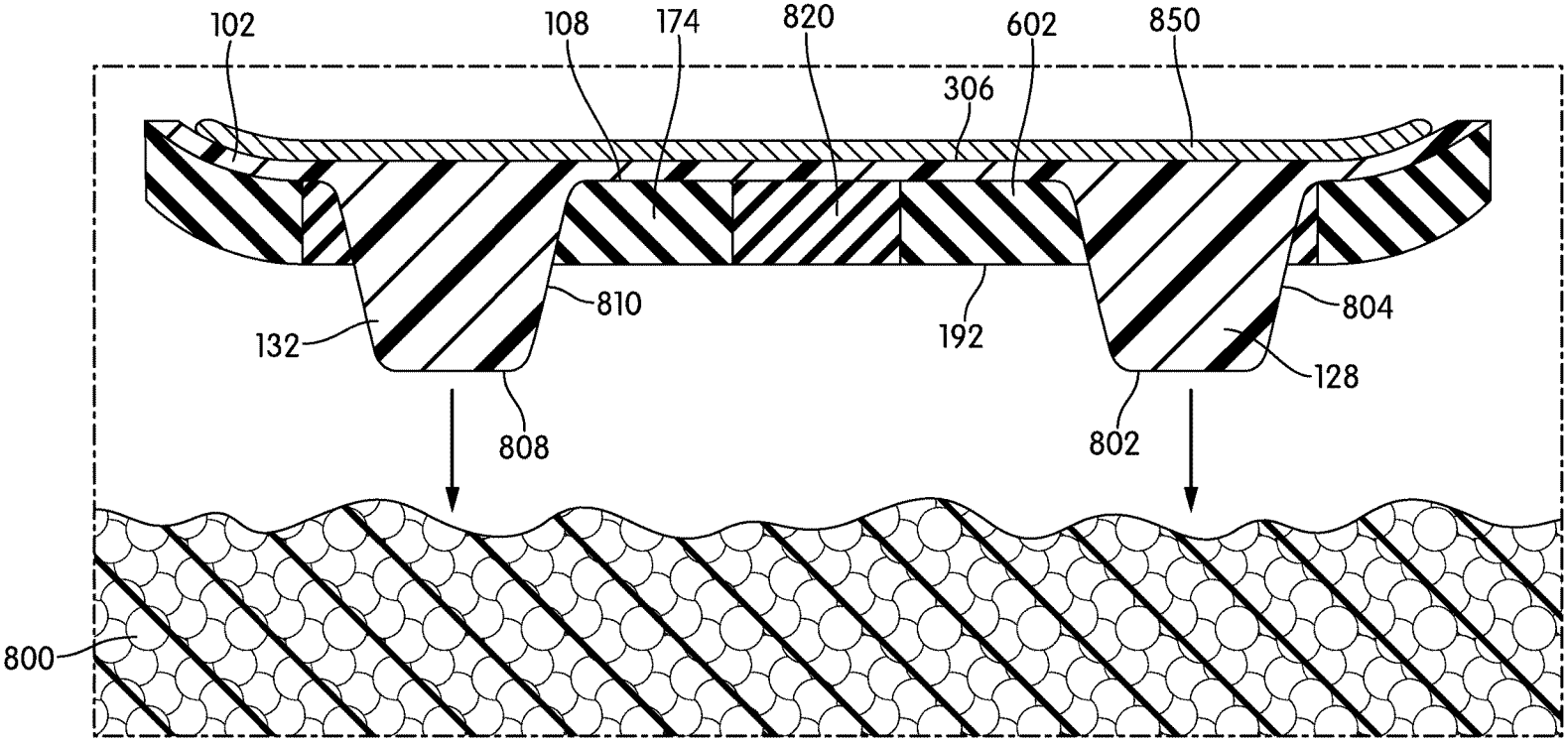
FIG. 8 is a rear view of cleats of the sole plate of FIG. 1 before being submerged in mud.
Figure 9:
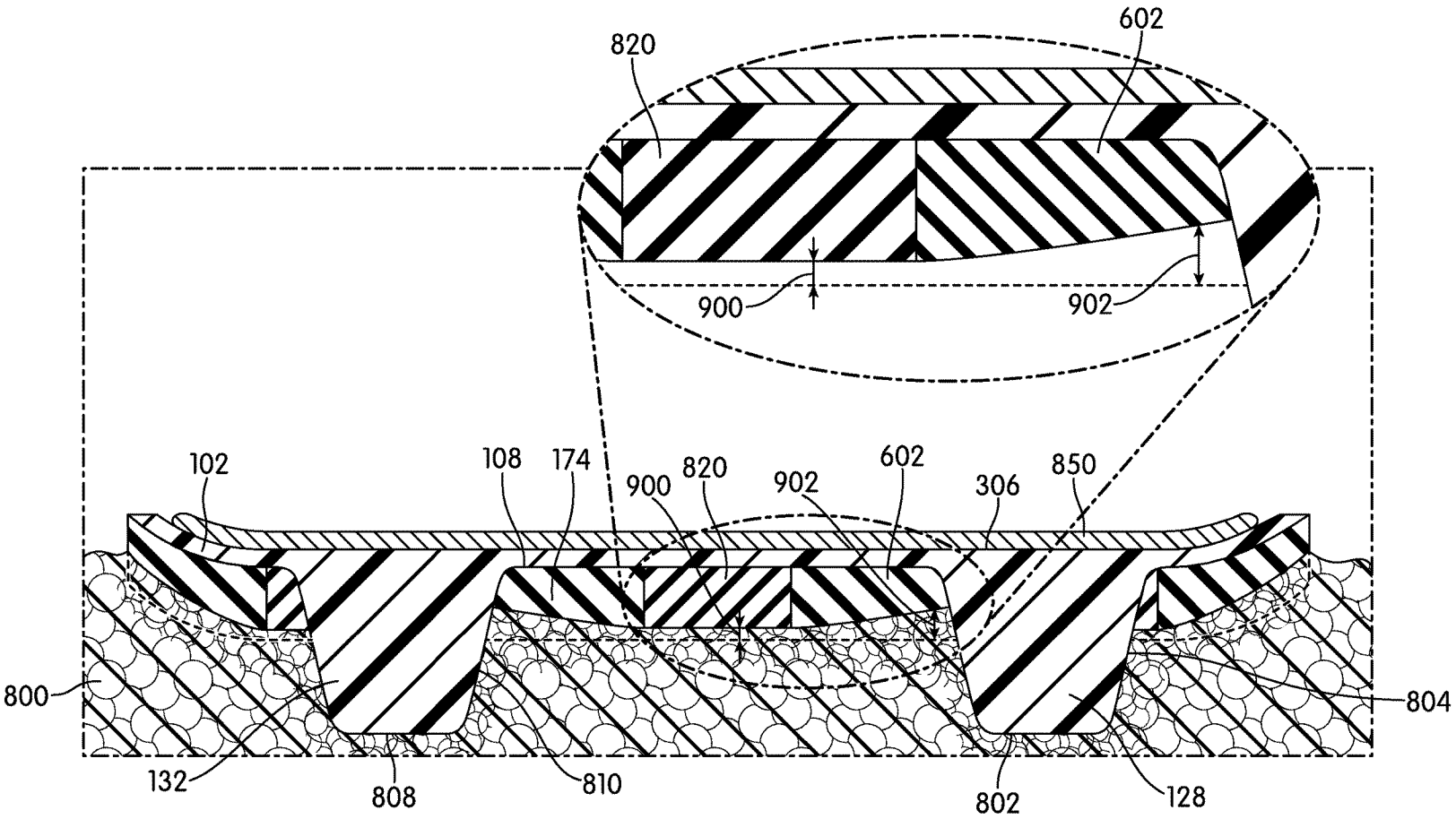
FIG. 9 is a rear view of cleats of the sole plate of FIG. 1 being submerged in mud.
Figure 10:
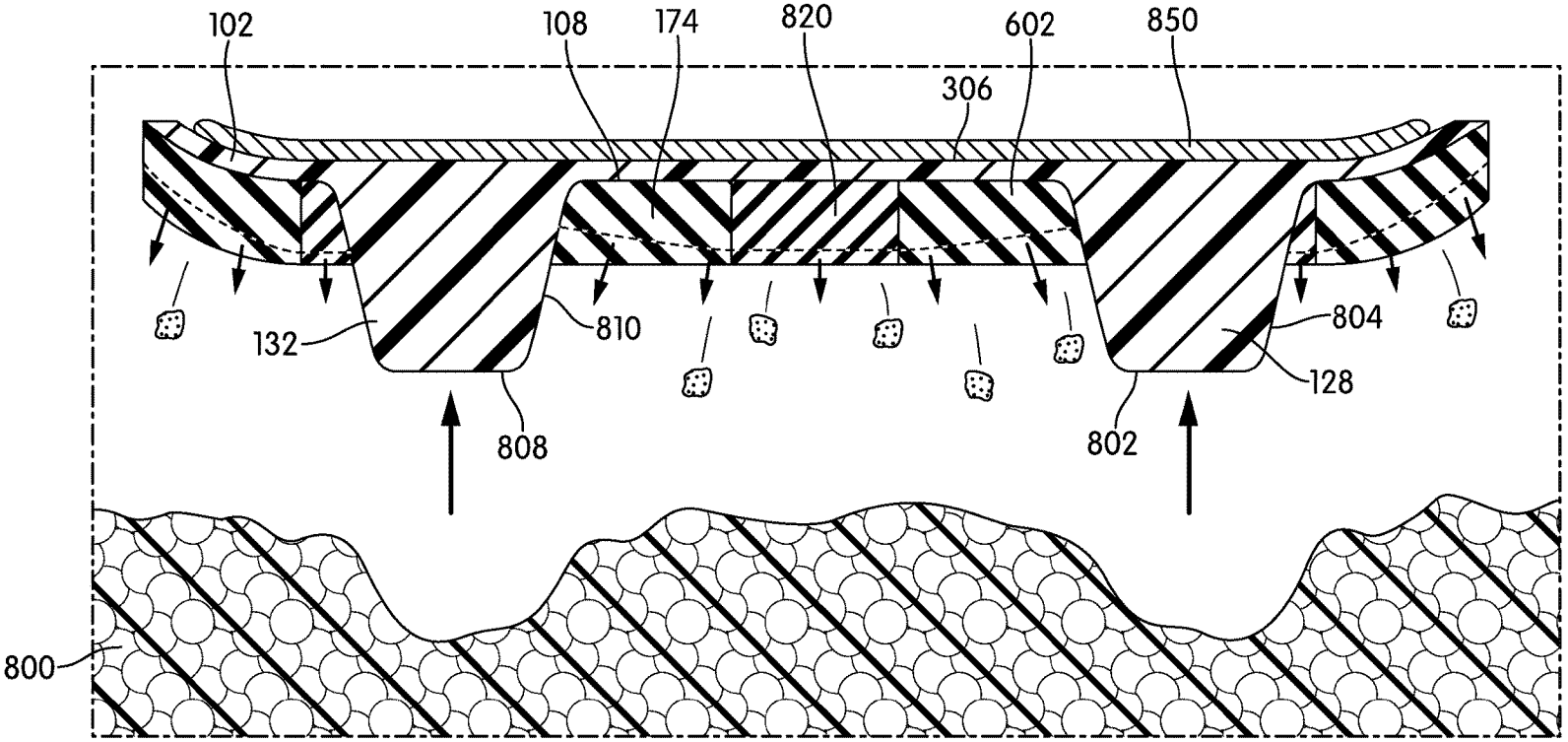
FIG. 10 is a rear view of the cleats of the sole plate of FIG. 1 after being submerged in mud.

The terminal end of at least one cleat may be a substantially flat surface. For example, as shown in FIGS. 8-10, terminal end 802 may be a substantially flat surface. In some embodiments, a substantially flat surface of the terminal end of at least one cleat may be substantially parallel with the lower surface of the sole plate. In some embodiments, a substantially flat surface of the terminal end of the at least one cleat may be substantially angled with respect to the lower surface of the sole plate. In other embodiments, the terminal end of at least one cleat may have other shapes that are not substantially flat. For example, the terminal end of the cleat may be a substantially rounded surface. In another example, the terminal end of the cleat may be a surface having ridges. In yet another example, the terminal end of the cleat may be substantially conical.

In some embodiments, the cleats may have the same height, width, and/or thickness as each other. In other embodiments, the cleats may have different heights, different widths, and/or different thicknesses from each other. In some embodiments, a first set of cleats may have the same height, width, and/or thickness as each other, while a second set of cleats may have a different height, width, and/or thickness from the first set of cleats. For example, as shown in FIGS. 1-5, first cleat 110, second cleat 112, third cleat 114, fourth cleat 116, fifth cleat 118, sixth cleat 120, seventh cleat 122, and eighth cleat 124 may make up a first set of cleats having a first width and/or thickness, while ninth cleat 126, tenth cleat 128, eleventh cleat 130, and twelfth cleat 132 may make up a second set of cleats having a second width and/or thickness.

The cleats may be arranged in any cleat pattern on the sole plate. For example, as shown in FIGS. 1-2, first cleat 110, second cleat 112, fifth cleat 118, and sixth cleat 120 may be substantially aligned with one another adjacent a medial perimeter of lower surface 108 of sole plate 102 in forefoot region 140. Similarly, in some embodiments, third cleat 114, fourth cleat 116, seventh cleat 122, and eighth cleat 124 may be substantially aligned with one another adjacent a lateral perimeter of lower surface 108 of sole plate 102 in forefoot region 140. In some embodiments, ninth cleat 126 and tenth cleat 128 may be substantially aligned with one another along the medial perimeter of lower surface 108 of sole plate 102 in heel region 142. In some embodiments, eleventh cleat 130 and twelfth cleat 132 may be substantially aligned with one another along the lateral perimeter of lower surface 108 of sole plate 102 in heel region 142. In some embodiments, thirteenth cleat 134 may be disposed on medial side 172 of lower surface 108 of sole plate 102 in a position between first cleat 110 and the front edge of sole plate 102. In some embodiments, fourteenth cleat 136 and fifteenth cleat 138 may be disposed in a forefoot region 140 of sole plate 102 substantially along a centerline of lower surface 108 of sole plate 102. While the embodiments of FIGS. 1-13 are all illustrated with the same cleat pattern (arrangement), it is understood that other cleat patterns may be used with the sole plate. The arrangement of the cleats may enhance traction for a wearer during cutting, turning, stopping, accelerating, and backward movement.

The sole plate may include components other than cleats that contact a playing surface and increase traction. In some embodiments, the sole plate may include traction elements (not shown) that are smaller than cleats or studs. The traction elements on the sole plate may increase control for a wearer when maneuvering forward on a surface by engaging the surface. Additionally, traction elements may also increase the wearer's stability when making lateral movements by digging into a playing surface. In some embodiments, the traction elements may be molded into the sole plate. In some embodiments, the sole plate may be configured to receive removable traction elements.

In some embodiments, the article of footwear may include at least one outer layer disposed in the forefoot region of the sole plate. For example, as shown in FIGS. 1-5, outer layer 174 extends continuously from forefoot region 140 through midfoot region 144 to heel region 142. In some embodiments, the article of footwear may include a plurality of outer layers disposed in the forefoot region of the sole plate. In further embodiments, multiple outer layers may be disposed within the different regions of the sole plate. For example, in some embodiments, an outer layer may encompass forefoot region 140 and heel region 142; however midfoot region 144 of sole plate 102 may remain exposed. Additionally, in some embodiments, some cleats may not be surrounded by an outer layer. For example, in some embodiments, first cleat 110, thirteenth cleat 134 and third cleat 114 may be surrounded by an outer layer; however, second cleat 112, fourteenth cleat 136, and fourth cleat 116 may not be surrounded by an outer layer. Additionally, in some embodiments, a space between some of the cleats may remain uncovered by an outer layer. That is, in some embodiments, the cleats may be surrounded by an outer layer; however, sole plate 102 may be exposed between each of the outer layers surrounding the cleats.

In some embodiments, a single outer layer may be disposed along a majority of the lower surface of the sole plate. For example, as shown in FIGS. 1-5, outer layer 174 may be disposed along a majority of lower surface 108 of sole plate 102. The number of outer layers included on the lower surface of the sole plate may vary depending upon a variety of factors, e.g. the size, shape, and/or pattern of the cleats.

As previously stated, an outer layer may be disposed on the lower surface of the sole plate. In some embodiments, an outer layer may have at least one hole through which the shaft of at least one cleat may extend. For example, as shown in FIGS. 1-5, outer layer 174 may be disposed on lower surface 108 and may have a first hole 184 through which first cleat 110 may extend and a second hole 149 through which second cleat 112 may extend. Third cleat 114 may extend through a third hole 151. Fourth cleat 116 may extend through a fourth hole 153. Fifth cleat 118 may extend through a fifth hole 155. Sixth cleat 120 may extend through a sixth hole 157. Seventh cleat 122 may extend through a seventh hole 159. Eighth cleat 124 may extend through an eighth hole 161. Ninth cleat 126 may extend through a ninth hole 162. Tenth cleat 128 may extend through a tenth hole 129. Eleventh cleat 130 may extend through an eleventh hole 166. Twelfth cleat 132 may extend through a twelfth hole 168. Thirteenth cleat 134 may extend through a thirteenth hole 188. Fourteenth cleat 136 may extend through a fourteenth hole 193. Fifteenth cleat 138 may extend through a fifteenth hole 195. Such holes may reduce the weight of the article of footwear, may maintain a certain level of traction between the lower surface and the ground, and/or may allow traction elements other than cleats to extend from the sole plate to the ground.

Sole plate 102 may include a single outer layer 174 extending along a majority of the surface area of lower surface 108. In embodiments in which the sole plate includes a single outer layer, the outer layer may extend along substantially the entire perimeter of the lower surface of the sole plate. For example, as shown in FIG. 2, outer layer 174 may extend along substantially the entire perimeter of lower surface 108. Outer layer 174 may have a lateral edge 171 and a medial edge 173 opposite lateral edge 171. Lateral edge 171 may correspond with the lateral edge of sole plate 102. Medial edge 173 may correspond with the medial edge of sole plate 102. Outer layer 174 may have a forward edge 200 that corresponds with the forward edge of sole plate 102. Outer layer 174 may have a rearward edge 201 that corresponds with the rearward edge of sole plate 102.

Figure 3:
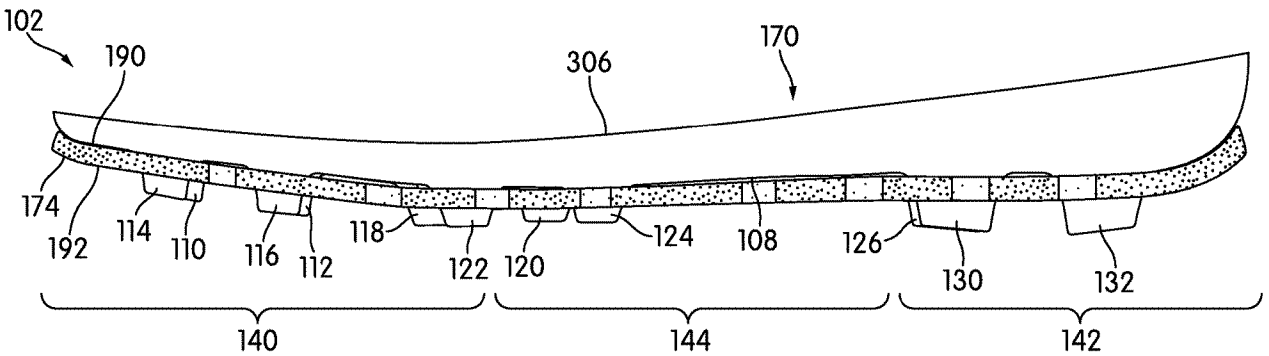
FIG. 3 is a side view of the sole plate of FIG. 1 from a lateral side.
Figure 4:
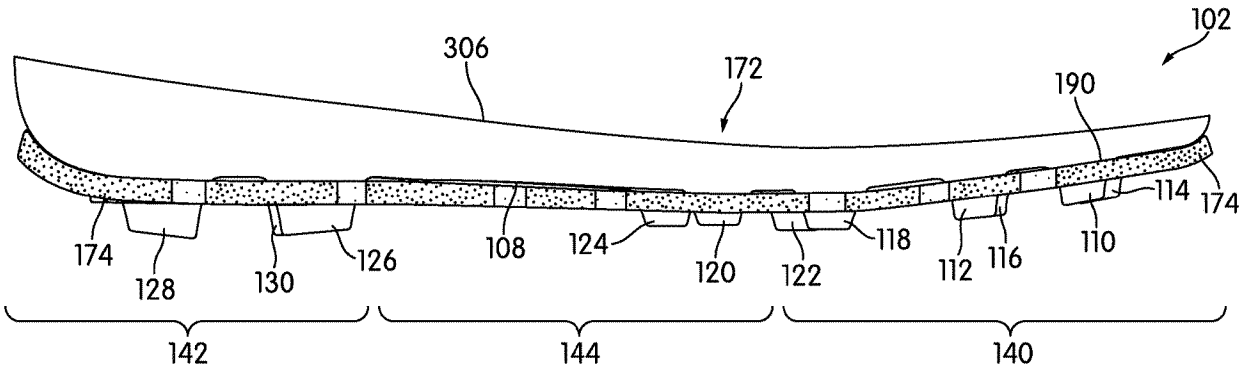
FIG. 4 is a side view of the sole plate of FIG. 1 from a medial side.
Figure 5:
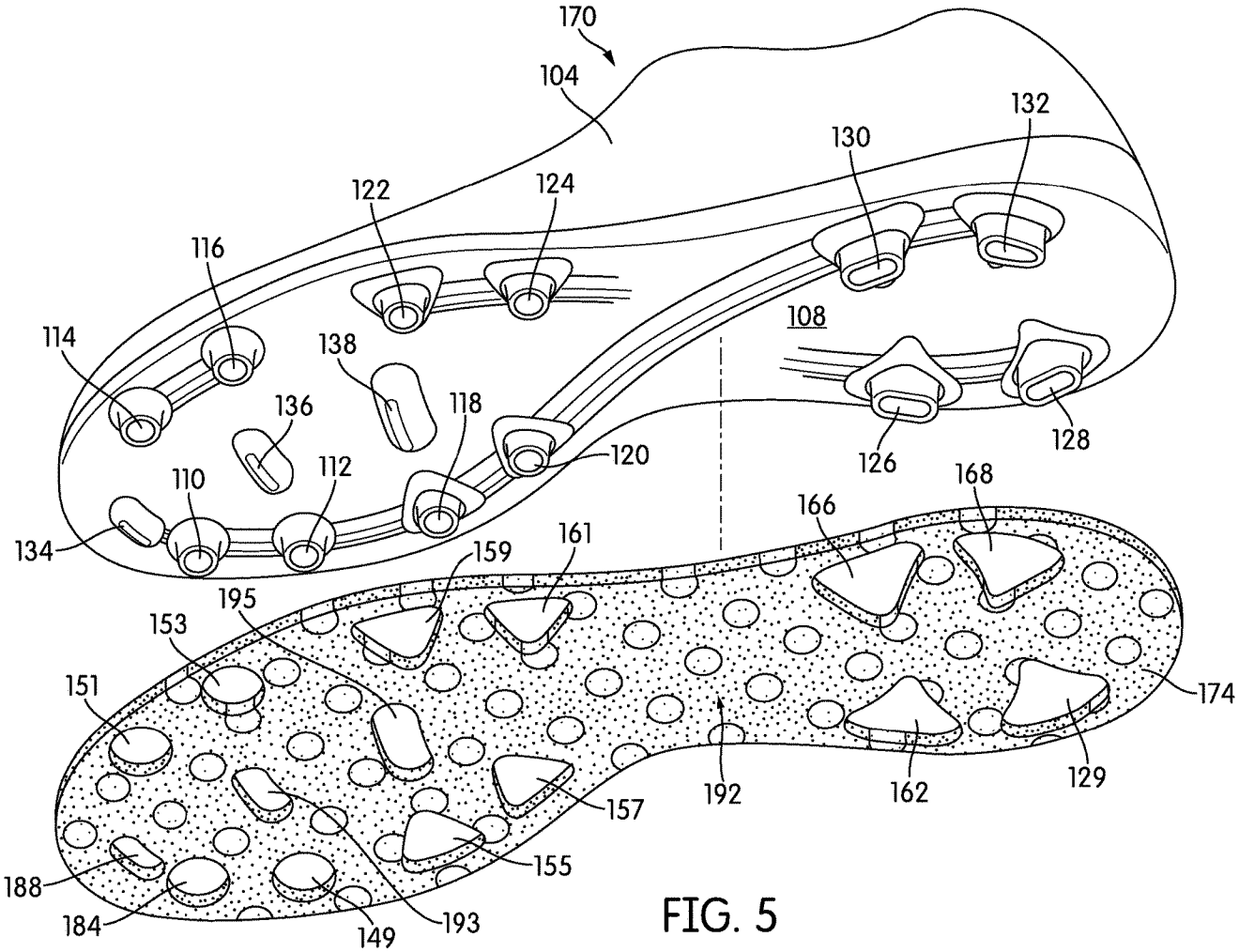
FIG. 5 is an exploded view of the sole plate of FIG. 1.

In some embodiments, an outer layer may contact the lower surface of the sole plate. For example, as shown in FIGS. 3 and 4 upper surface 190 of outer layer 174 may contact lower surface 108 of sole plate 102. In some embodiments, an outer layer may contact the shaft of the sole plate. For example, as shown in FIGS. 8-10, outer layer 174 may contact shaft 804 of sole plate 102. In some embodiments, at least one cleat may extend through an opening in the outer layer such that the terminal end of the cleat is exposed. For example, as shown in FIG. 8, tenth cleat 128 may extend through an opening 129 in outer layer 174 such that terminal end 802 of tenth cleat 128 is exposed.

In some embodiments, the outer layer may terminate at a point between the terminal end of the first cleat and a lower surface of the sole plate. For example, as shown in FIGS. 8-10, outer layer 174 may terminate at a point between terminal end 802 of tenth cleat 128 and lower surface 108 of sole plate 102. That is, lower surface 192 of outer layer 174 is located in a different plane than is terminal end 802. Additionally, terminal end 802 extends beyond lower surface 192 of outer layer 174.

The outer layer may have a variety of shapes. The shape and size of the outer layer may be selected based on a variety of factors. For example, the shape and size of the outer layer may be selected based on the shape and size of the cleats or the material used to make the outer layer. In some embodiments, as shown in FIGS. 1-5, the outer layer may be contoured to lower surface 108 of sole plate 102. In some embodiments, as shown in FIGS. 1-5, the outer layer may have a substantially uniform thickness. The thickness of outer layer 174 may be defined as the distance from lower surface 192 to upper surface 190 of outer layer 174.

The outer layer may be made of a resilient material. In some embodiments, to prevent water and/or mud from penetrating the outer layer, the outer layer may be made of a hydrophobic and/or oleophobic material. For example, the outer layer may be made of rubber, silicone, and/or latex. In some embodiments, as shown in FIGS. 1-5, the outer layer may be formed from a foam material. In some embodiments the foam may be a polyester polyurethane foam.

Figure 6:
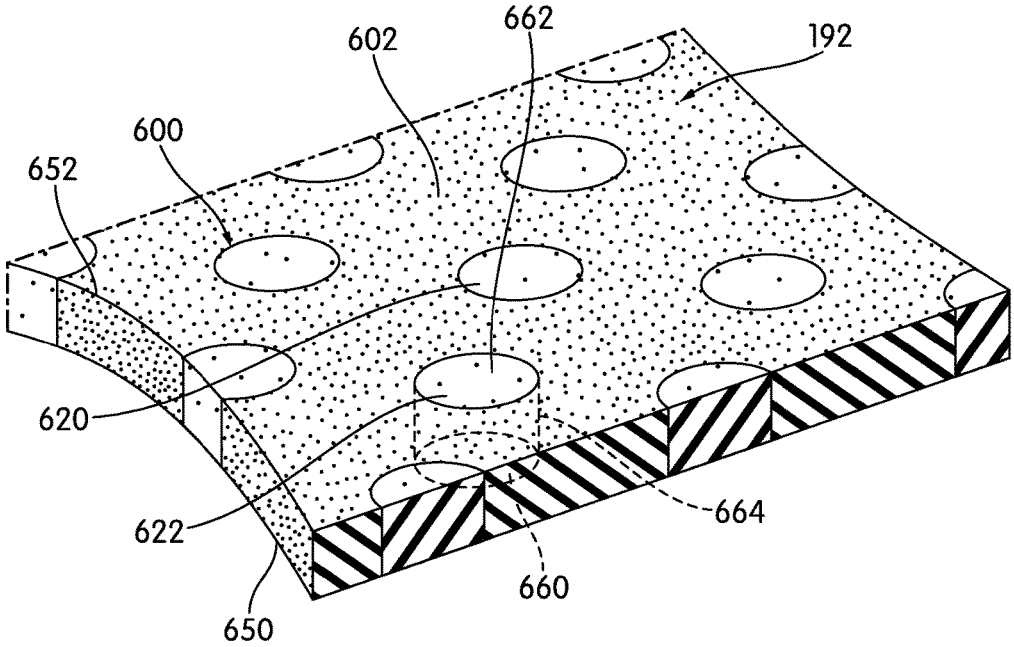
FIG. 6 is an isometric bottom view of an embodiment of a portion of an outer layer.

In some embodiments, the outer layer may include portions that are continuous throughout. For example, as seen in FIG. 6, a portion of outer layer 174 is depicted. A portion is continuous from end to end and side to side. Continuous region 602 does not have any breaks or stoppages which separate one portion of continuous region 602 from another portion within outer layer 174.

Figure 7:
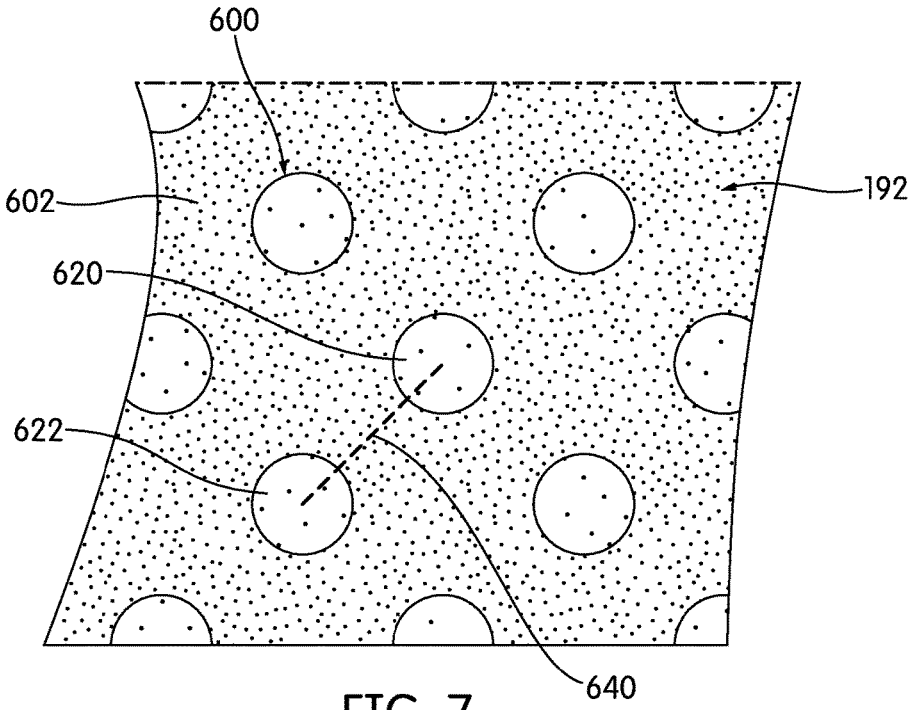
FIG. 7 is a bottom view of an embodiment of a portion of an outer layer.

In some embodiments, the outer layer may include discontinuous regions. A discontinuous region may be a region that does not extend continuously from end to end and side to side of an outer layer. Additionally, the discontinuous regions may be substantially surrounded by the continuous region. For example, as shown in FIGS. 6 and 7, discontinuous regions 600 are located within a matrix of continuous region 602. Discontinuous regions 600 may include multiple resilient members. For example, first resilient member 620 and second resilient member 622 are depicted in FIGS. 6-7. In some embodiments, discontinuous regions 600 may include more resilient members.

In some embodiments, continuous region 602 may be formed of a first foam. In some embodiments discontinuous regions 600 may be formed of a second foam. In some embodiments, the first foam and the second foam may be chemically the same. For example, both the first foam and the second foam may be polyester polyurethane. The first foam and the second foam may, however, have different physical properties. For example, in some embodiments the first foam may be more compressible than the second foam. In some embodiments, the foams may have different densities. By changing density within the foam, the compressibility of the foams may differ. In some embodiments, the foams may be closed cell or open cell. In some embodiments, the cells may be large or small.

Continuous region 602 may have an upper surface 650 and a lower surface 652. In some embodiments, the distance between upper surface 650 and lower surface 652 may be approximately five millimeters. That is, the thickness of continuous region 602 may be five millimeters. In other embodiments, the thickness of continuous region 602 may be less or greater than five millimeters.

In some embodiments, second resilient member 622 may have an upper surface 660 and a lower surface 662. Upper surface 660 and lower surface 662 may be used to describe individual resilient members as well as discontinuous regions 600. Upper surface 660 and lower surface 662 may be spaced about the thickness of side surface 664. That is, upper surface 660 and lower surface 662 and side surface 664 may form discontinuous regions 600. In some embodiments, the thickness of discontinuous regions 600 between upper surface 660 and lower surface 662 may be approximately five millimeters. In other embodiments, the thickness of discontinuous regions 600 between upper surface 660 and lower surface 662 may be less or greater than five millimeters.

In some embodiments, upper surface 660 of discontinuous regions 600 may be located in the same plane as upper surface 650 of continuous region 602. Additionally, lower surface 662 of discontinuous regions 600 may be located in the same plane as lower surface 652 of continuous region 602. Therefore upper surface 650 of continuous region 602 and upper surface 660 of discontinuous regions 600 may be flush or even with one another. Additionally, lower surface 652 of continuous region 602 and lower surface 662 of discontinuous regions 600 may also be flush or even with one another.

In some embodiments, discontinuous regions may be joined to a continuous region along a side surface from an upper surface to a lower surface. For example, second resilient member 622 may be joined to continuous region 602 alongside surface 664 of discontinuous regions 600. In some embodiments, side surface 664 may be fixed to continuous region 602. In some embodiments, side surface 664 may be glued to continuous region 602. In other embodiments, discontinuous regions 600 may be placed within continuous region 602 during the formation of outer layer 174. In still further embodiments, continuous region 602 and discontinuous regions 600 may be co-formed or melted.

In some embodiments, outer layer 174 may be formed using multiple techniques. In some embodiments, discontinuous regions 600 may be co-molded with continuous region 602. In other embodiments, discontinuous regions 600 and continuous region 602 may be formed independently from one another and then joined together. In further embodiments, discontinuous regions 600 and continuous region 602 may be formed by an extruding process. In some embodiments, discontinuous region 600 and continuous region 602 may be co-extruded such that each discontinuous region 600 and continuous region 602 are formed at the same time.

In some embodiments, outer layer 174 may be shaped similarly to the shape of an outsole. In some embodiments, outer layer 174 may be formed in the shape of an outsole. That is, in some embodiments, outer layer 174 may be extruded or molded or otherwise formed directly in the shape of an outsole. In contrast, in other embodiments, outer layer 174 may be formed as a sheet and then cut into the shape of an outsole. Additionally, in some embodiments, the holes which align with the cleats of sole plate 102 may be pre-formed into outer layer 174. That is, in some embodiments, outer layer 174 may be extruded or molded or otherwise pre-formed with holes which may align with cleats of sole plate 102. Additionally, the holes of outer layer 174 may be formed by cutting outer layer 174 after the formation of outer layer 174.

In some embodiments, outer layer 174 may be mechanically attached to sole plate 102. In some embodiments, an adhesive may be used to secure outer layer 174 to sole plate 102. In other embodiments, a fastener, nail, tack, button or screw may be used to secure outer layer 174 to sole plate 102.

In some embodiments, discontinuous regions 600 may be in the form of a cylinder. For example, in some embodiments, upper surface 660 may be circular and lower surface 662 may also be circular. Side surface 664 may connect upper surface 660 and lower surface 662, thereby forming a cylinder such as second resilient member 622, as depicted in FIGS. 6 and 7. In other embodiments, discontinuous regions 600 may be in the form of a prism. For example, in some embodiments the upper surface and lower surface of a resilient member may be triangular in shape. A side surface may connect the upper surface and lower surface and form a triangular prism. In other embodiments, the upper surface and lower surface may be other various shapes, forming various regular and irregular prisms and polyhedrons.

In some embodiments, discontinuous regions 600 may have a characteristic measurement. The characteristic measurement relates to a dimension of upper surface 660 and lower surface 662 of discontinuous regions 600. The characteristic measurement is defined as the diameter of a circle that can encircle the shape of the upper surface 660 or lower surface 662. In embodiments that utilize cylindrical discontinuous regions 600, such as second resilient member 622, the characteristic measurement is the diameter of the upper surface or lower surface of the cylinder. In embodiments in which the discontinuous regions form triangular prisms, the characteristic measurement would be the diameter of the smallest circle that could encompass the entire triangle.

In some embodiments, discontinuous regions 600 may be spaced an equal distance from one another. In some embodiments, discontinuous regions 600 may be spaced in varying distances from one another. In some embodiments, discontinuous regions 600 may be spaced apart by a distance relating to the characteristic measurement of discontinuous regions 600. In some embodiments, discontinuous regions 600 may be spaced apart by a distance of between about 150 percent to about 180 percent of the characteristic measurement from the center of the discontinuous regions. For example, in one embodiment, lower surface 662 of second resilient member 622 is a circle and has a diameter of about nine millimeters. Therefore the characteristic measurement of second resilient member 622 is about nine millimeters. The lower surface of first resilient member 620 also has a diameter of about nine millimeters. The center of second resilient member 622 is located a distance 640 away from the center of first resilient member 620. In some embodiments distance 640 may be about 16 millimeters. The percentage that the distance apart (16 millimeters) is of the characteristic measurement is about 178 percent.

In some embodiments, the characteristic measurement may be varied. In some embodiments the characteristic measurement may be approximately 1 mm. In other embodiments, the characteristic measurement may be approximately 20 mm. In further embodiments, the characteristic measurement may be between about 1 mm and about 20 mm. In other embodiments, the size of the characteristic measurement may be varied in order to form a particular layout of discontinuous regions 600 within outer layer 174.

In some embodiments, the surface area of upper surface 190 or lower surface 192 of outer layer 174 encompassed by discontinuous regions 600 may vary. For convenience, lower surface 192 may be used in describing the surface area of outer layer 174, however it should be recognized that the same ratios may be achieved with respect to upper surface 190. In some embodiments, a large percentage of lower surface 192 may include discontinuous regions 600. For example, in some embodiments, the cumulative area of lower surface 662 of discontinuous regions 600 may be approximately 50 percent of the surface area of lower surface 192 of outer layer 174. In other embodiments, the cumulative area of lower surface 662 of discontinuous regions 600 may be approximately 15 percent of the surface area of lower surface 192 of outer layer 174. In still further embodiments, the surface area of lower surface 662 of discontinuous regions may be between about 15 percent and about 50 percent of the surface area of lower surface 192 of outer layer 174. The percentage of the surface area of outer layer 174 encompassed by discontinuous regions 600 may be adjusted or varied by changing the size of discontinuous regions 600 as well as by changing the distance between each of the discontinuous regions.

In some embodiments, discontinuous regions 600 may have a different hardness than continuous region 602. In some embodiments, discontinuous regions 600 may have a higher hardness than continuous region 602. In some embodiments, discontinuous regions 600 may have an Asker C hardness between 25 and 60 Asker C. In a particular embodiment, discontinuous regions 600 may have an Asker C hardness of about 40 to 45 Asker C. Continuous region 602 may have an Asker C hardness between about 10 and 40 Asker C. In a particular embodiment, continuous region 602 may have an Asker C hardness of about 20 to 25 Asker C. In some embodiments, discontinuous regions 600 may have an Asker C hardness that is about 15 Asker C greater than the Asker C of continuous region 602. In other embodiments, the Asker C value of discontinuous regions 600 may be greater than 15 Asker C higher than the Asker C of continuous region 602.

In some embodiments, the hardness of continuous region 602 and discontinuous regions 600 may relate to the compressibility of each of the regions. A region with a higher Asker C may be less compressible than a region with a lower Asker C. A region with a higher compressibility may deform to a greater extent when subjected to a force.

The outer layer may be permanently affixed to the lower surface of the sole plate. For example, in some embodiments, the upper surface of an outer layer may be affixed to lower surface of sole plate by an adhesive. In some embodiments, the outer layer may be affixed to the lower surface of the sole plate by thermal bonding. For example, the outer layer and/or the lower surface of the sole plate may be heated to slightly soften and then the outer layer and the lower surface may be pressed together to fuse the two parts together. In some embodiments, the outer layer may be molded to the lower surface of the sole plate. In some embodiments, the above methods of affixing the outer layers to the sole plate can be combined. For example, an outer layer may be affixed to the lower surface of the sole plate by both thermal bonding and adhesive. Permanently affixing the outer layer to the lower surface of the sole plate may prevent the outer layer from becoming detached from the lower surface and may prevent mud and other debris from coming between the outer layer and the lower surface.

Figure 11:
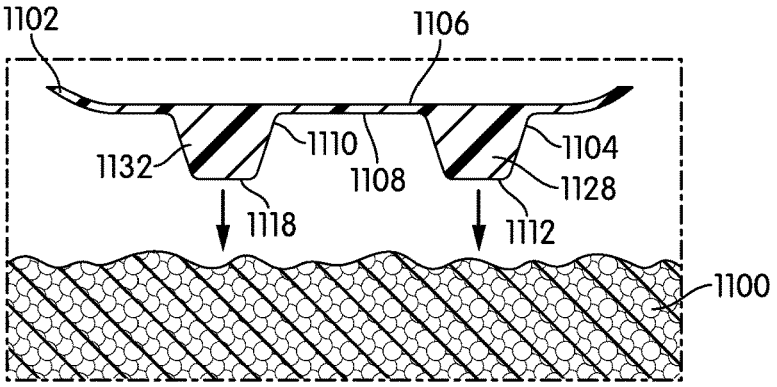
FIG. 11 is a rear view of a sole plate before being submerged in mud, according to another embodiment.
Figure 12:
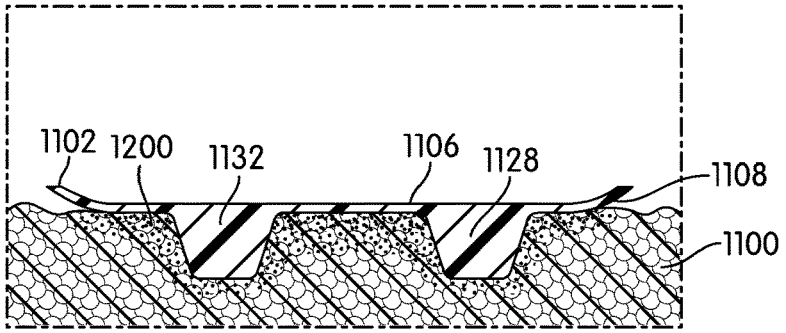
FIG. 12 is a rear view of the cleats of the sole plate of FIG. 11 being submerged in mud.
Figure 13:
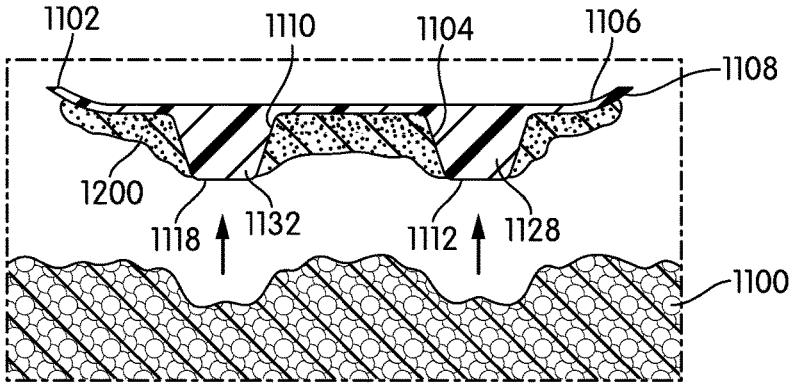
FIG. 13 is a rear view of the sole plate of FIG. 12 after the cleats are submerged in mud.

The details of FIGS. 8-10 will now be discussed in comparison with FIGS. 11-13, which show an alternative embodiment of a sole plate 1102. FIGS. 8-10 show how outer layer 174 may prevent mud and/or other debris from accumulating on the area surrounding tenth cleat 128 and twelfth cleat 132. FIGS. 11-13 show how sole plate 1102 packs mud 1100 as sole plate 1102 is pressed against mud 1100. Sole plate 1102 has an upper surface 1106 and a lower surface 1108 opposite upper surface 1106. Sole plate 1102 includes a first cleat 1128 having a shaft 1104 and a terminal end 1112 and a second cleat 1132 having a shaft 1110 and a terminal end 1118. As sole plate 1102 is moved in the direction of the arrows shown in FIG. 9 toward mud 1100, sole plate 1102 packs mud 1100, as shown in FIG. 10. Packed mud 1200 is packed against lower surface 1108 of sole plate 1102 and the shafts of the cleats when sole plate 1102 is moved away from mud 1100 in the direction of the arrows shown in FIG. 13.

In comparison with FIGS. 11-13, FIGS. 8-10 show a sole plate according to an exemplary embodiment preventing mud from accumulating. FIG. 8 shows outer layer 174 and the cleats before article of footwear 100 comes into contact with mud 800. The sole structure may include a sockliner 850 located adjacent to upper surface 306 of plate 102. FIG. 9 illustrates outer layer 174 and the cleats contacting mud 800. Tenth cleat 128 and twelfth cleat 132 may penetrate mud 800 and outer layer 174 may be made of a material that allows outer layer 174 to compress between a lower surface 108 of sole plate 102 and an upper surface of mud 800. The compression of outer layer 174 may reduce the amount of mud 800 being packed by sole plate 102. FIG. 10 shows tenth cleat 128 and twelfth cleat 132 after emerging from mud 800. Without being packed against outer layer 174, mud 800 may not stick to outer layer 174 after sole plate 102 is moved away from mud 800, as shown in FIG. 10. Outer layer 174 may spring back to its former position after no longer being compressed between lower surface 108 of sole plate and the upper surface of mud 800. As shown in FIG. 10, continuous region 602 may spring back a greater distance than does resilient member 820. This may facilitate in forcing mud from outer layer 174. As outer layer 174 springs back to its former position, outer layer 174 may additionally scrape mud and/or other debris away from the surface of the cleats. Accordingly, the outer layer may prevent mud from accumulating upon the cleat and/or the area surrounding the cleat.

The compression of outer layer 174 in particular is shown in FIG. 9. As shown, as mud 800 presses against outer layer 174, continuous region 602 may deform a distance 902. An enlarged view is also shown without mud 800 to illustrate distance 902 and distance 900 clearly. Resilient member 820 may deform a different distance, distance 900. Both continuous region 602 and resilient member 820 or other members of discontinuous regions 600 may compress. The different amount of compression, however, may force mud to fall away from outer layer 174. The different compression may allow for a shear stress to form within mud 800 located between discontinuous regions 600 and continuous region 602. The shear stress may increase during the decompression of outer layer 174 and cause mud 800 to fall away from outer layer 174. Additionally, as mud 800 falls away near the junction of discontinuous regions 600 and continuous region 602, mud 800 may adhere to other portions of mud and pull the mud away from layer 174.

Further, the different compressibility levels of outer layer 174 may make an uneven compressible surface. As shown in FIG. 9, outer layer 174 curves based on the compressibility levels of outer layer 174. For example, outer layer 174 compresses more in continuous region 602 area than in resilient member 820 area. The curved nature of outer layer 174 may increase the distance along lower surface 192 from tenth cleat 128 to twelfth cleat 132 as compared to an uncompressed state. As outer layer 174 decompresses when removed from mud 800, the distance along lower surface 192 from tenth cleat 128 to twelfth cleat 132 decreases. This change in distance may force mud 800 off of outer layer 174 or may reduce the adherence of mud 800 to outer layer 174. Additionally, by including distinct regions with different hardnesses the likelihood of having an even compression along outer layer 174 (that is, when distance 902 and distance 900 are the same), is decreased. Therefore, the likelihood of changing the distance along lower surface 192 when compressed is increased. This change in distance may assist in reducing the likelihood that mud may accumulate on sole plate 102.

The sole plate of the article of footwear may be subjected to varying tests and field research to determine the amount of ground surface material that could accumulate on the sole structure. In some embodiments, the article of footwear could be subjected to actual game play situations. The games could be any sport, such as, soccer, football, baseball, field hockey, lacrosse, softball, rugby, cross-country or any sport using an article of footwear with traction elements on the sole structure. The ground surfaces could be any ground surface material that could accumulate on the sole structure of an article of footwear, such as, mud, dirt, grass, turf or any other material either wet or dry. In the exemplary embodiment, following a thirty (30) minute wear test on a wet grass field, a weight of the debris adhered to the sole plate is at least 15% less than a weight of debris adhered to an exterior surface of a control sole structure (such as sole plate 1102). The control sole plate may be identical to the sole structure except that the control sole structure does not include the outer layer.

While various embodiments have been described, the description is intended to be exemplary, rather than limiting and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims. As used in the claims, "any of" when referencing the previous claims is intended to mean (i) any one claim, or (ii) any combination of two or more claims referenced.

What is claimed is:

1. A sole structure comprising:

an outer layer including:

a substantially continuous first region;

a second region comprising a plurality of resilient members, the plurality of resilient members being substantially discontinuous and each having a hardness that is at least 15 Asker C hardness greater than the Asker C hardness value of the first region;

the first region extending from an upper surface of the outer layer to a lower surface of the outer layer, the plurality of resilient members also extending from the upper surface of the outer layer to the lower surface of the outer layer;

the first region having a first exposed outer surface, the plurality of resilient members having a second exposed outer surface, the first exposed outer surface being flush with the second exposed outer surface such that the first exposed outer surface and the second exposed outer surface collectively define a ground-contacting surface, each of the plurality of resilient members being in contact with and surrounded by the substantially continuous first region at the ground-contacting surface; and a plate including at least one cleat, a portion of the at least one cleat extending from the ground-contacting surface.

2. The sole structure of claim 1, wherein the plate has a hardness of at least 90 Shore A.

3. The sole structure of claim 1, wherein the first region has a first surface area, the second region has a cumulative surface area, wherein the cumulative surface area is between about 15 percent and about 50 percent of the total of the first surface area and the cumulative surface area.

4. The sole structure of claim 1, wherein the first region has a hardness between about 10 and about 45 Asker C.

5. The sole structure of claim 1, wherein the plurality of resilient members have a hardness between about 25 and about 60 Asker C.

6. The sole structure of claim 1, wherein the first region is composed of polyester polyurethane foam.

7. The sole structure of claim 1, wherein each of the plurality of resilient members has a characteristic measurement, wherein each of the plurality of resilient members is spaced apart by a distance of between about 150 percent to about 180 percent of the characteristic measurement from the center of each of the plurality of resilient members.

8. The sole structure of claim 7, wherein the characteristic measurement of the plurality of resilient members is between about 1 mm and about 20 mm.

9. The sole structure of claim 1, wherein the plurality of resilient members includes a first resilient member and a second resilient member, the first resilient member and the second resilient member being cylindrical, each cylinder having a face at the upper surface and a face at the lower surface.

10. The sole structure of claim 1, wherein the plurality of resilient members includes a first resilient member and a second resilient member, the first resilient member and the second resilient member being essentially evenly spaced from one another.

11. The sole structure of claim 1, wherein each of the plurality of resilient members has a sidewall that extends from the upper surface to the lower surface.

12. The sole structure of claim 11, wherein each of the plurality of resilient members is joined to the first region along the entire sidewall.

13. A method of manufacturing a sole structure comprising:

forming an outer layer having a first region that is substantially continuous and a second region including a plurality of resilient members that are substantially discontinuous:

wherein forming the outer layer includes providing the resilient members with a hardness that is at least 15 Asker C hardness greater than the Asker C hardness value of the first region;

wherein forming the outer layer includes extending the first region from an upper surface of the outer layer to a lower surface of the outer layer and extending the plurality of resilient members from the upper surface of the outer layer to the lower surface of the outer layer;

wherein forming the outer layer includes providing the first region with a first exposed outer surface and the plurality of resilient members with a second exposed outer surface;

wherein forming the outer layer includes aligning the first exposed outer surface with the second exposed outer surface such that (i) the first exposed outer surface is flush with the second exposed outer surface (ii) the first exposed outer surface and the second exposed outer surface collectively define a ground-contacting surface, and (iii) each of the plurality of resilient members is in contact with and surrounded by the substantially continuous first region at the ground-contacting surface; and extending at least one cleat through the outer layer such that a portion of the at least one cleat extends from the ground-contacting surface.

14. The method of claim 13, wherein forming the outer layer includes providing each of the plurality of resilient members with a characteristic measurement and spacing apart the plurality of resilient members from one another by a distance of between about 150 percent to about 180 percent of the characteristic measurement from the center of each of the plurality of resilient members.

15. The method of claim 13, wherein forming the outer layer includes providing the plurality of resilient members with essentially the same shape.

16. The method of claim 13, further comprising attaching an upper to the sole structure.

17. The method of claim 13, wherein forming the outer layer includes evenly spacing the resilient members from one another.

18. The method of claim 13, further comprising providing a plate with the at least one cleat.

19. The method of claim 13, further comprising providing the plurality of resilient members with a sidewall that extends from the upper surface to the lower surface.

20. The method of claim 19, further comprising joining the plurality of resilient members to the first region along the entire sidewall.

21. The method of claim 13, further comprising attaching the outer layer to a plate.

22. The method of claim 13, further comprising contacting a first side surface of the plurality of resilient members with a second side surface of the first region at a junction of the first side surface and the ground-contacting surface.

* * * * *